US007893884B2

(12) United States Patent
Nakamura et al.

(10) Patent No.: US 7,893,884 B2
(45) Date of Patent: Feb. 22, 2011

(54) EMBEDDED DOOR HANDLE ANTENNA APPARATUS COMPRISING A MAGNETIC CORE

(75) Inventors: Syuuji Nakamura, Kanagawa-ken (JP); Kazuhiko Gotou, Kanagawa-ken (JP); Ryuji Minemura, Kanagawa-ken (JP); Kenji Mizushima, Kanagawa-ken (JP)

(73) Assignee: Alpha Corporation, Yokohama-shi, Kanagawa-ken (JP)

( * ) Notice: Subject to any disclaimer, the term of this patent is extended or adjusted under 35 U.S.C. 154(b) by 98 days.

(21) Appl. No.: 10/572,752

(22) PCT Filed: Sep. 16, 2004

(86) PCT No.: PCT/JP2004/013995

§ 371 (c)(1),
(2), (4) Date: Mar. 21, 2006

(87) PCT Pub. No.: WO2005/029639

PCT Pub. Date: Mar. 31, 2005

(65) Prior Publication Data

US 2007/0273596 A1 Nov. 29, 2007

(30) Foreign Application Priority Data

Sep. 22, 2003 (JP) ..... P2003-329695

(51) Int. Cl.
*H01Q 1/32* (2006.01)
*H01Q 1/00* (2006.01)
*H01Q 7/08* (2006.01)

(52) U.S. Cl. ..... 343/713; 343/711; 343/787; 343/788

(58) Field of Classification Search ..... 343/788, 343/787, 711, 713
See application file for complete search history.

(56) References Cited

U.S. PATENT DOCUMENTS

| | | | | |
|---|---|---|---|---|
| 5,253,226 | A | 10/1993 | Ganter | |
| 5,396,698 | A | 3/1995 | Orthmann et al. | |
| 6,400,330 | B1 * | 6/2002 | Maruyama et al. | 343/788 |
| 6,400,338 | B1 * | 6/2002 | Mejia et al. | 343/873 |
| 6,795,032 | B2 * | 9/2004 | Ieda et al. | 343/713 |
| 2002/0113747 | A1 * | 8/2002 | Tessier et al. | 343/787 |
| 2003/0184489 | A1 * | 10/2003 | Maruyama et al. | 343/788 |
| 2006/0022886 | A1 * | 2/2006 | Hein et al. | 343/787 |

FOREIGN PATENT DOCUMENTS

| | | |
|---|---|---|
| JP | 08097616 | 4/1996 |
| JP | 08166446 | 6/1996 |
| JP | 10117107 | 5/1998 |
| JP | 2003-224410 | 8/2003 |
| WO | 99/19585 A1 | 4/1999 |

* cited by examiner

*Primary Examiner*—Trinh V Dinh
(74) *Attorney, Agent, or Firm*—The Nath Group; Jerald L. Meyer; Robert T. Burns

(57) ABSTRACT

An antenna apparatus of the present invention has an antenna having a core (2) around which an insulative covered conductor (3) is wound. The core has a magnetic core (1) and a wiring layer which are laminated on each other. The magnetic core (1) is made of flexible soft magnetic material. A wiring space is formed inside of the antenna apparatus. With this structure, the packing density is enhanced.

3 Claims, 4 Drawing Sheets

EMBEDDED DOOR HANDLE ANTENNA APPARATUS COMPRISING A MAGNETIC CORE

RELATED APPLICATIONS

This application is a 371 of PCT/JP04/13995 filed Sep. 16, 2004, which claims priority under 35 U.S.C. 119 to an application JP 2003-329695 filed on Sep. 9, 2003, the contents of which are incorporated herein by reference.

TECHNICAL FIELD

The present invention relates to an antenna apparatus having an antenna including a core around which an insulation covered conductor is wound.

BACKGROUND ART

As an antenna apparatus used for a keyless entry system of an automobile, one described in Japanese Patent Application Laid-open No. 2003-224410 is known. In the conventional technique, the antenna is formed such that an insulative covered conductor is wound around a core made of ferrite or the like.

DISCLOSURE OF INVENTION

In this conventional technique, however, when it is required to accommodate other electronic components together with the antenna apparatus in a small space, it is necessary to prepare another wiring space for supplying electricity to the electronic components or for sending or receiving signals, and there is a problem that it is difficult to downsize the apparatus.

The present invention has been achieved in order to solve the above problem, and it is therefore an object of the invention to provide an antenna apparatus capable of enhancing the packing density by forming a wiring space in the apparatus.

BRIEF DESCRIPTION OF DRAWINGS

FIGS. 3A, 3B, 3C, and 3D show an antenna constituting the antenna apparatus of the invention, wherein FIG. 3A is a plan view of the antenna, FIG. 3B is a sectional view taken along the line 3B-3B shown in FIG. 3A, FIG. 3C is a sectional view taken along the line 3C-3C shown in FIG. 3A and shows a modification of the antenna shown in FIG. 3A, and FIG. 3D is a block diagram showing the antenna apparatus.

BEST MODE FOR CARRYING OUT THE INVENTION

Figure 1:
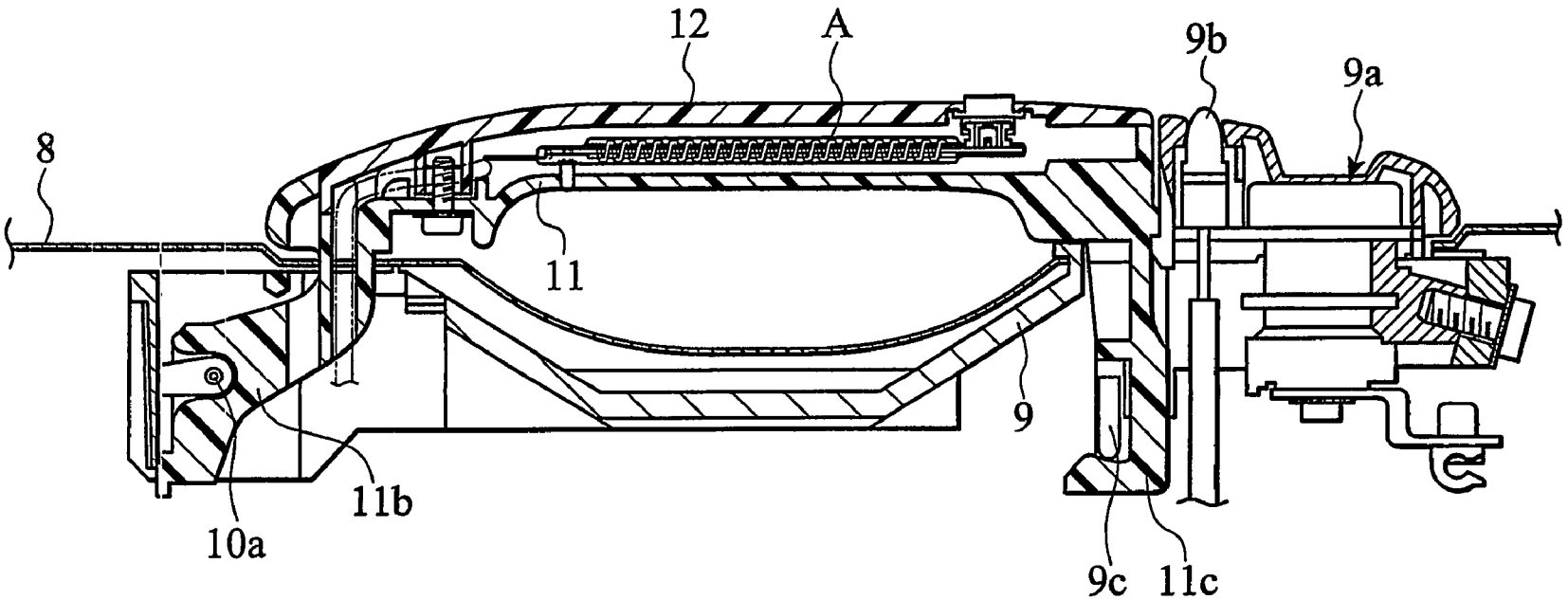
FIG. 1 is a sectional view of a handle apparatus in which an antenna apparatus of the present invention is disposed.
Figure 2:
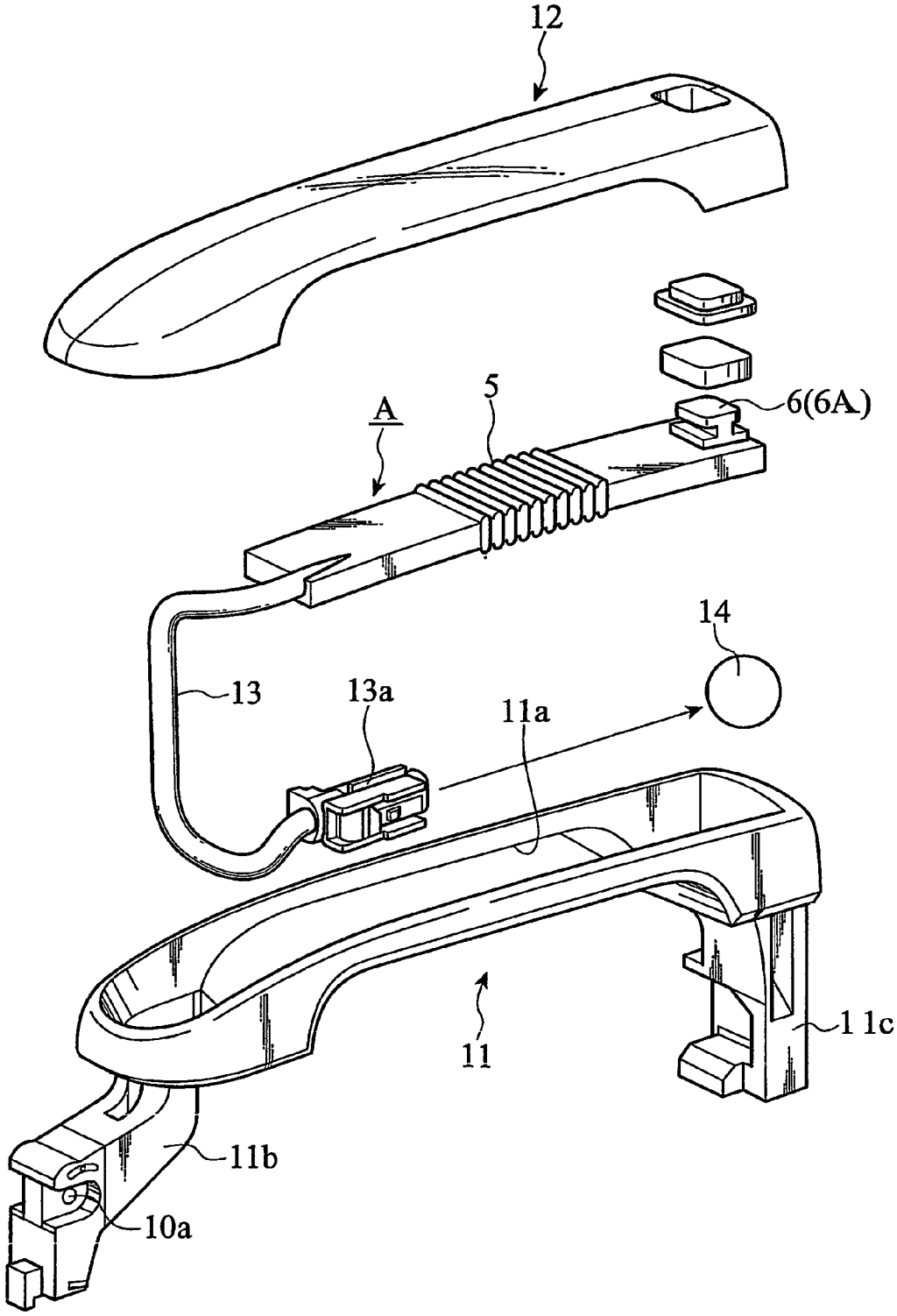
FIG. 2 is an exploded perspective view of a handle in which an antenna apparatus of the present invention is disposed.

FIGS. 1 and 2 show an embodiment of the present invention. This embodiment is mounted on a door outside handle apparatus of an automobile, and is used as a constituent part of a keyless entry system. A handle apparatus comprises a handle base 9 fixed to a door panel 8 of the vehicle, and a handle 10 mounted on the handle base 9. If the handle 10 is rotated around a pivot 10*a* of the handle base 9, a door lock apparatus (not shown) disposed on the inner side of the door is operated.

An auxiliary lock 9*a* and a lock switch 9*b*, which can be operated by a key plate, are disposed in the handle base 9. If the auxiliary lock 9*a* is operated, the door lock apparatus can be opened, and if the lock switch 9*b* is pushed down, the door lock apparatus can be locked.

As shown in FIG. 2, the handle 10 of the handle apparatus is long in the longitudinal direction (long direction of the vehicle). The handle 10 has an antenna accommodating recess 11*a* formed in the body member 11. The opening of the antenna accommodating recess 11*a* is closed by a cover member 12. The body member 11 and the cover member 12 are made of synthetic resin. One end of the body member 11 is formed with a hinge connection portion 11*b* with respect to the handle base 9. The other end of the body member 11 is formed with an operation leg 11*c* which operates the door lock apparatus by operating an operating section 9*c* mounted on the handle base 9 by rotating the handle 10.

As shown in FIGS. 3A to 3D, the antenna A is accommodated in an antenna accommodating recess 11 *a* of the body member 11. The antenna A has flexible printed wiring board (printed board 4). A magnetic core 1 is laminated on each of a front surface and a back surface of the flexible printed wiring board to form a core 2, and an insulation covered conductor 3 is wound around the core 2. The flexible printed board 4 further extends from a region where the insulation covered conductor 3 is wound around the core 2, i.e., from the coiled section 5. Both ends of the flexible printed board 4 are respectively provided with a switch (electronic component 6A) and a light-emitting diode (electronic component 6B). The coiled section 5 is located between the electronic component 6A and the electronic component 6B. It is possible to use a "BUSTERAID (tradename)" produced by NEC TOKIN Corporation as the magnetic core 1.

The flexible printed board 4 is formed with an element mounting land on which the switch 6A and the light-emitting diode 6B are to be mounted, an external connection land to which the external connection cable 13 is connected, and a pattern wire 4*a* which connects the element mounting land and the external connection land. The external connection land is formed with a pattern wire 4*a*' for a power source for taking out electricity to be supplied to the coil and for taking out induced electromotive force at the coil. It is preferable that the power source pattern wire 4*a*' is formed at a position which does not pass through the coil.

It is preferable that the pattern wires 4*a* and 4*a*', especially the pattern wire 4*a* which passes through the coil is formed straightly in parallel to a center line of the coil so that linkage with respect to the magnetic flux at the coil is prevented.

The antenna A is constituted in the above-described manner. The entire antenna A is sealed with synthetic resin, and is formed as a unit. After the antenna A is assembled into the handle 10, a connector 13*a* provided on one end of an external connection cable 13 is connected to a controller 14 formed on the side of the vehicle in a plug-in manner.

The electronic component 6 mounted on the flexible printed board 4 is appropriately changed by a function allocated to the handle 10 in the keyless entry system. In this embodiment, a switch 6A is controlled by the controller 14 so that the switch 6A functions as a request switch.

That is, if a user pushes down the switch 6A of the handle 10 when the user drives a vehicle, the controller 14 operates the communicating section 14*a* to emit communication radio wave from the antenna A to communicate with respect to the driver's portable terminal apparatus, and when the controller 14 confirms a match of the ID or the like of the portable terminal apparatus, the controller 14 unlocks the lock apparatus, and emits the light-emitting diode 6B to illuminate feet of the driver. When the driver gets off the vehicle, if the driver comes out from the vehicle and pushes down the lock switch 9*b* disposed on the handle base 9, the lock apparatus is locked.

Figure 3A:
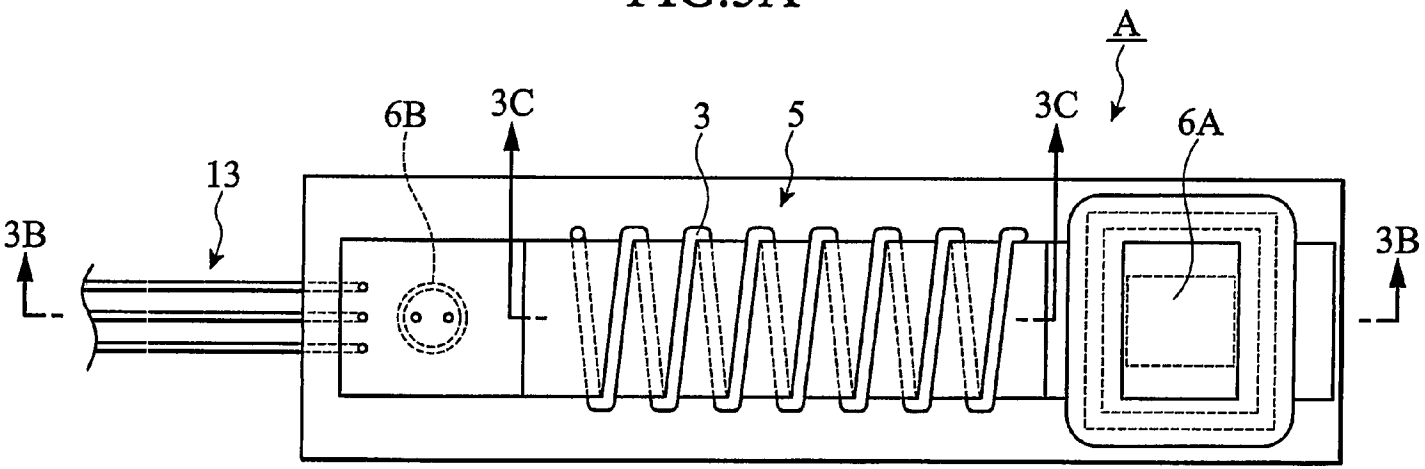
Figure 3B:
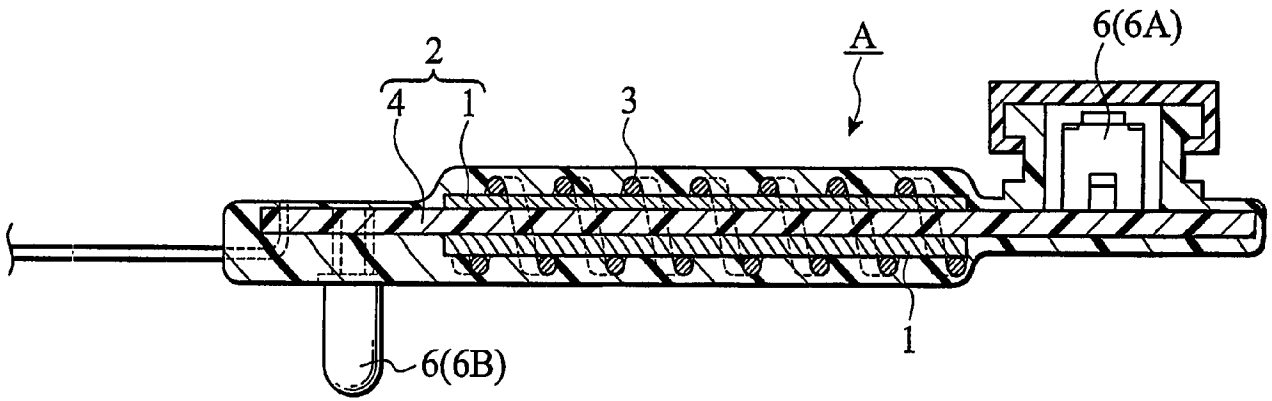
Figure 3C:
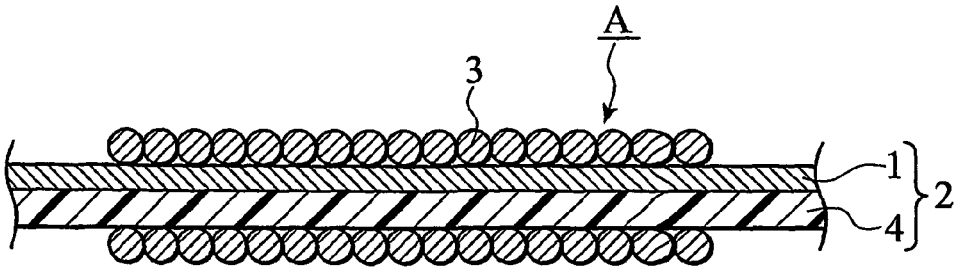

The core 2 is laminated on the magnetic core 1 on the front and back surfaces of the flexible printed board 4 in the above explanation, the core 2 may be laminated on the magnetic core 1 on one surface of the flexible printed board 4 as shown in FIG. 3C.

Figure 3D:
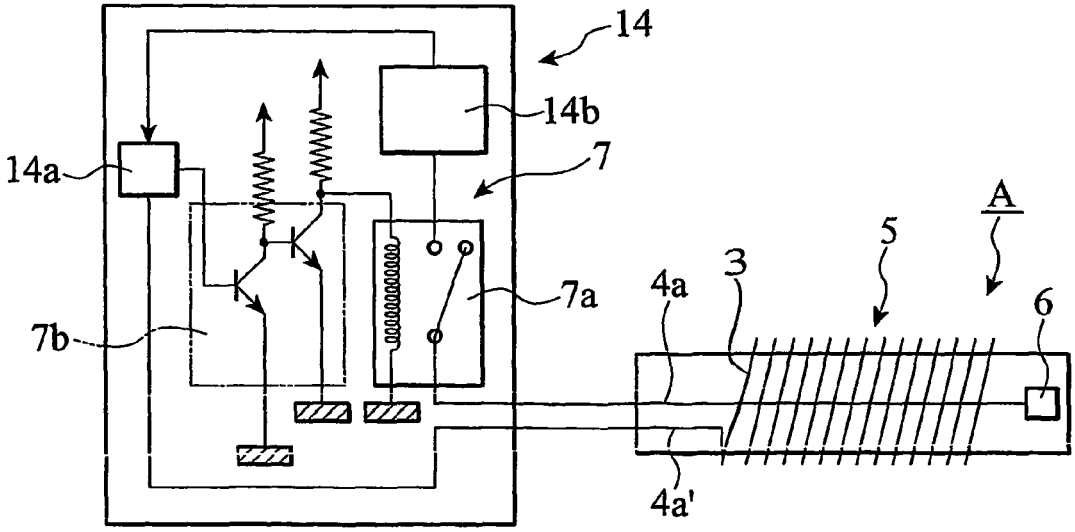

In order to prevent the mutual influence between the coil and the pattern wire 4*a* on the flexible printed board 4, it is effective to provide the controller 14 with an electricity control section 7 and the antenna A and the electricity control section 7 constitute the antenna apparatus as shown in FIG. 3D. In this modification, when radio wave is sent from the antenna A, the electronic component 6 is cut away. The electricity control section 7 comprises a relay switch 7*a* and a relay control circuit 7*b*.

If a sending command is output from the controller 14 in the controller 14 to the communicating section 14*a*, the communicating section 14*a* drives the relay control circuit 7*b* to energize the relay switch 7*a*. If the relay switch 7*a* is energized, the pattern wire 4*a* with respect to the electronic component 6 is cut away from the control section 14*b*.

In the above explanation, the pattern wire 4*a* is physically or mechanically separated using the relay switch 7*a*. Alternatively, the relay switch 7*a* may be separated electrically using a switching element. In the above explanation, the pattern wire 4*a* is separated in synchronization with the operation of the communicating section 14*a*, but the separating condition and timing thereof can appropriately be changed while taking into account a condition that mutual effect between the coil and the pattern wire 4*a* such as electromagnetic induction, or performance of the antenna A or the control section 14*b*.

If the magnetic core 1 has magnetic characteristics such as magnetic permeability required as a core of the antenna, a material of the magnetic core 1 is not limited. For example, a composite magnetic material in which magnetic powder made of soft material and organic connecting material are combined as a binder can also be used other than the flexible magnetic body made of soft material.

Therefore, in this embodiment, since the core 2 includes the wiring layer and the antenna itself can be used as a wire element, the space can effectively be used.

The wiring layer can be formed on the printed board 4. If a flexible printed wiring board is used as the printed board 4, the wiring layer can be wound around the magnetic core 1 instead of superposing the wiring layer on the magnetic core 1. When the magnetic core 1 comprises a large number of hard magnetic materials which are connected to each other through bent joints and the magnetic core 1 has plasticity, or when a material itself of the magnetic core 1 has flexibility, if a flexible printed wiring board is used as the printed board 4, it is possible to maintain a merit obtained from the fact that the magnetic core 1 has the flexibility.

In order to reduce the interaction with respect to the coil as small as possible, it is preferable that a direct conductive wire having no waveform variation of voltage and current is used. One example thereof is a wire for supplying electricity to an illuminant (electronic component 6) such as a diode which is supplied with electricity from a battery and is lighted.

In this case, if the printed board 4 is extended from the coiled section 5 and this extended portion is provided with the electronic component 6 such as the diode, it is unnecessary to newly fix the board to another portion or to connect the other portion and the board to each other, and the assembling operation is facilitated.

In order to reduce adverse influence caused by interaction with respect to the wire at the time of tuning operation when radio wave is sent or received, if the electricity control section 7 is provided, it is possible to control the timing of excitation of the coil, energizing the wiring layer and the electrical connection.

The invention claimed is:

1. An embedded door handle antenna, comprising:

a door handle having a hollow portion therein;

an antenna embedded within the hollow portion of the door handle, the embedded antenna comprising a flexible magnetic core containing a flexible magnetic body made of mechanically soft magnetic material having plasticity and flexibility which is laminated to a coiled wiring layer, around which a coil of an insulation covered conductor is wound;

a pattern wire passing in parallel to a center line of the coil, the pattern wire configured such that linkage with respect to the magnetic flux at the coil is prevented;

a controller formed on a side of a vehicle;

a communication section connected with the controller; and a connector attached to one end of the embedded antenna, the connector facilitating connection of the embedded antenna to a power circuit and the communication section, wherein the embedded antenna is energized by an action of at least one of a request switch mounted on the flexible magnetic core and a proximity of a keyless entry component;

the flexible magnetic core is provided with an extending portion which outwardly extends from a coiled section around which the insulation covered conductor is wound, and a light emitting component is mounted on the extending portion wherein the coil section located between the light emitting component and the request switch.

2. The embedded door handle antenna according to claim 1, wherein the wiring layer is a printed circuit board.

3. The embedded door handle antenna according to claim 1, further comprising an electricity control section which permits and prohibits energizing the wiring layer depending upon an operation state of the embedded antenna.

* * * * *